US005898017A

United States Patent [19]

Chang

[11] Patent Number: 5,898,017

[45] Date of Patent: Apr. 27, 1999

[54] MULTICOLOR CHROMOGENIC SYSTEM HAVING IMPROVED IMAGE QUALITY

[75] Inventor: John C. H. Chang, Naperville, Ill.

[73] Assignee: Wallace Computer Services, Inc., Hillside, Ill.

[21] Appl. No.: 08/914,093

[22] Filed: Aug. 19, 1997

[51] Int. Cl.[6] ..... B41M 5/132

[52] U.S. Cl. ..... 503/204; 427/150; 427/152; 503/206; 503/226

[58] Field of Search ..... 427/150–152; 503/204, 206, 226

[56] References Cited

U.S. PATENT DOCUMENTS

| | | | |
|---|---|---|---|
| 3,781,230 | 12/1973 | Vassiliades et al. | 260/2.5 B |
| 3,839,064 | 10/1974 | Vincent | 106/308 M |
| 4,010,292 | 3/1977 | Shackle et al. | 427/150 |
| 4,170,483 | 10/1979 | Shackle et al. | 106/21 |
| 4,322,466 | 3/1982 | Tomlinson | 428/199 |
| 4,425,386 | 1/1984 | Chang | 427/256 |
| 5,405,821 | 4/1995 | Minami et al. | 503/207 |
| 5,464,804 | 11/1995 | Kawakami et al. | 503/217 |
| 5,478,695 | 12/1995 | Leenders | 430/259 |
| 5,482,912 | 1/1996 | Furuya et al. | 503/207 |
| 5,524,934 | 6/1996 | Schwan et al. | 283/95 |
| 5,543,382 | 8/1996 | Watanabe et al. | 503/224 |
| 5,618,063 | 4/1997 | Chang et al. | 283/67 |

*Primary Examiner*—Bruce H. Hess
*Attorney, Agent, or Firm*—Roylance, Abrams, Berdo & Goodman, L.L.P.

[57] ABSTRACT

A heat-sensitive document capable of providing multiple colors comprising a support having at least one surface bearing a first coating comprising a substantially colorless, chromogenic composition which is capable of producing a first color, a second coating covering a portion of the first coating, the second coating being an opaque coating, comprising an opacifying agent and a hydrophobic, polymeric binding agent, and a localized third coating covering at least a portion of said second coating comprising a substantially colorless, heat-activatable chromogenic composition capable of producing a second color, preferably under the application of heat. The opaque coating is "dual-functional", since it both enhances multicolor image quality and acts as a primer for adhering the localized chromogenic coating composition.

30 Claims, 2 Drawing Sheets

MULTICOLOR CHROMOGENIC SYSTEM HAVING IMPROVED IMAGE QUALITY

FIELD OF THE INVENTION

The present invention is directed to a multicolor chromogenic system which provides improved multicolor image quality. More particularly, this invention relates to documents having multicolor chromogenic coatings, which can be activated by heat to produce visible multicolored markings for highlighting information and for determining authenticity, using an intermediate dual-functional coating for enhancing image quality and for improving adhesion of chromogenic coatings

BACKGROUND OF THE INVENTION

U.S. Pat. No. 5,618,063 to Chang et al., the entire disclosure of which is hereby incorporated by reference, discloses a multicolor heat sensitive verification system which can be used to prevent unauthorized or fraudulent reproduction of documents which can be reproduced by a color copier, such as cash register receipts, checks, pharmaceutical prescriptions, sweepstakes tickets, and the like. The heat sensitive multicolor system can also be used to selectively highlight desired portions of shipping labels, ATM receipts, promotional coupons, cash register receipts by application of thermal printers.

One form of multicolored heat-sensitive document is prepared by applying one or more localized heat-sensitive coatings over a fully coated substrate which had been coated with a heat-sensitive chromogenic coating. Application of heat to such coatings, for example, by the heated stylus of a thermal printer, results in different colors where the heat has been applied. However, difficulties have been experienced with such multicolor heat-sensitive documents because the underlying color can still be seen through the color of the overlying, localized coating resulting in reduced image quality of the color of the overlying coating.

SUMMARY OF THE INVENTION

A multicolor, heat-sensitive chromogenic system has now been discovered which not only provides enhanced multicolor image quality, but, in addition, provided improved adhesion between chromogenic coatings.

The system of the present invention involves a document capable of providing multiple colors, comprising a support having at least one surface bearing a first coating comprising a substantially colorless, chromogenic composition capable of producing a first color, a dual-functional second coating covering a portion of the first coating, which second coating comprises a substantially opaque, localized coating comprising an opacifying agent and a hydrophobic, polymeric binder, and a third coating covering at least a portion of the second coating comprising a substantially colorless, chromogenic composition capable of producing a second color.

Each of the chromogenic compositions comprise a color former and a color developer, the color former and the color developer being substantially colorless prior to reaction, but chemically react when heated to produce a visible colored image. The first and second coatings are non-coextensive.

Preparation of documents having multicolored, heat-sensitive systems formed by applying one or more localized heat-sensitive coatings over a substrate fully coated with a heat-sensitive coating presents various problems.

Heat-sensitive chromogenic coatings comprise minute solid particles of substantially colorless color former and color developer as key ingredients. When heat is applied to the coating, the color developer becomes melted or partially melted so that it may react with the color former to produce a visible colored image. When a direct thermal printer is used as the heat source, the molten mass of the color developer and the color former can form a build-up on the heated printer stylus. To remedy this problem, a heat-resistant protective topcoat is normally applied.

Commercially available fully coated substrates are normally coated with protective topcoats applied by the manufacturers. Depending upon the end application, the topcoat may be formulated to provide chemical resistance, water resistance, abrasion resistance, color stability, and blood resistance for labels used in grocery stores. Such topcoats are water insoluble. The dry topcoat may also be water-soluble, and yet heat-resistant, such as topcoats used on facsimile paper.

When the topcoat is water-resistant, it is very difficult to apply a water-based material to the topcoat. Practically all chromogenic coatings are water-based making it very difficult to coat the localized chromogenic coating over the water-resistant topcoat.

Another problem is encountered because the topcoat is transparent and the layer of the localized chromogenic coating to be applied is not thick or smooth enough to completely or mostly block the underlying developed color of the fully coated chromogenic layer. This results in the color of the underlying layer being seen through the developed color of the overlying localized coating.

One attempt to solve the problem involves incorporating an inorganic pigment, such as titanium dioxide, in the localized chromogenic coating itself in an attempt to block the underlying color. However, appealing primary colors, blue, red and yellow, cannot be truly presented with the titanium dioxide incorporated in the localized chromogenic coating.

Surprisingly, it has been found that by interposing an opaque coating comprising an inorganic pigment, preferably, titanium dioxide, and a polymeric binder or binding agent, which is hydrophobic when dried, between the coatings of chromogenic compositions, particularly when the underlying chromogenic composition is overcoated with a topcoat which may be water-resistant, the interposed opaque coating not only successfully blocks the developed color of the underlying developed coating, but, in addition, can act as a "primer coat" to adhere the localized chromogenic coating to the underlying chromogenic coating through the topcoat. Thus, the opaque coating of the present invention is "dual-functional", since it improves multicolor image quality by blocking unwanted color, but also acts as a primer to aid in bonding the chromogenic coatings.

According to a preferred embodiment of the invention, the binder in the opacifying coating comprises topcoat material used to protect the underlying chromogenic coating.

According to a further embodiment of the present invention, the color former and color developer react by application of heat.

BRIEF DESCRIPTION OF THE DRAWINGS

Referring now to the drawings which form a part of the original disclosure.

DETAILED DESCRIPTION OF THE INVENTION

Figure 1:
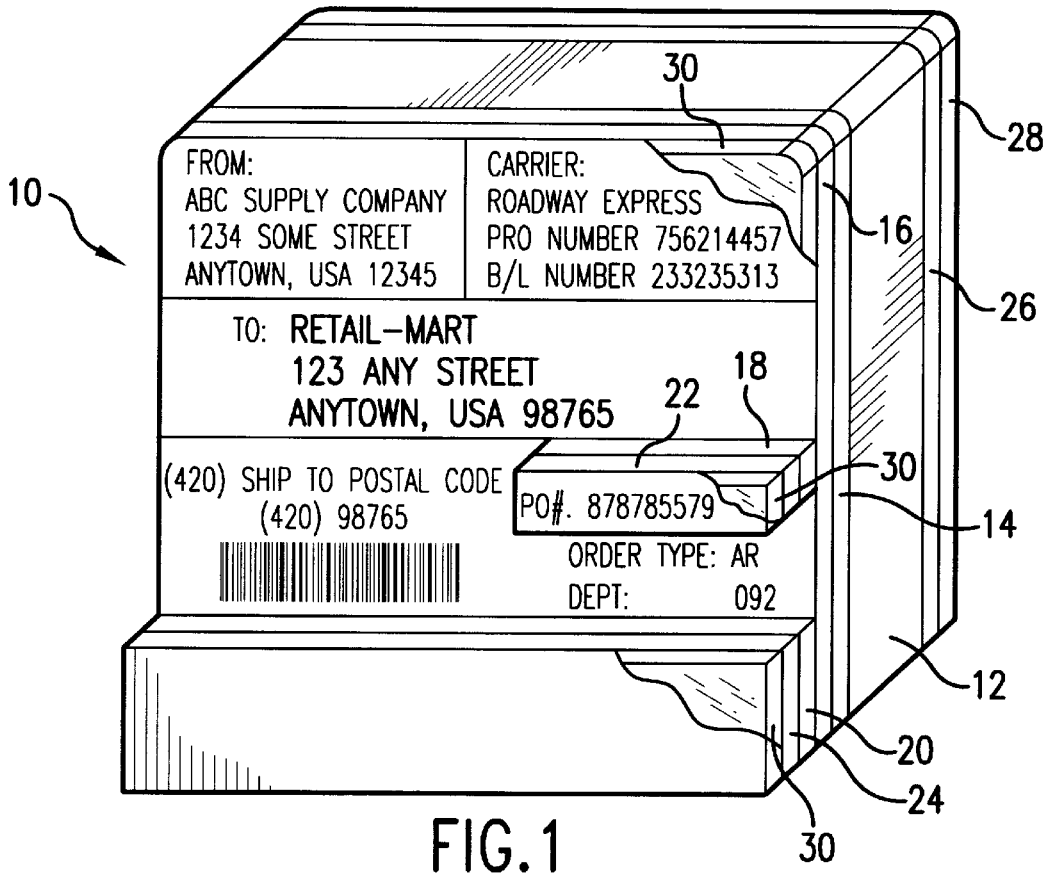
FIG. 1 is a schematic and perspective view of a pressure sensitive label having thermally printed purchase order information and employing the dual-functional opaque coating of the present invention.

Referring to the drawings, FIG. 1 illustrates a thermal highlighting system in combination with a document 10 which is a pressure-sensitive label having thermally printed purchase order information.

The term "document" as used herein is intended to include any type of document or paper which can be reproduced by a photocopier, particularly a color photocopier, or other reproduction equipment. Documents of particular interest are documents which can be color-highlighted, such as pressure-sensitive labels, as well as those documents which have a high incidence of reproduction for fraudulent purposes. In preferred embodiments of the invention, the document is a pressure-sensitive label, a sales receipt or a redeemable coupon.

Referring to FIG. 1, mailing label 10 comprises substrate 12, such as paper or a paper substitute, such as plastic, which is fully coated with a self-contained chromogenic coating 14 of a substantially colorless, heat activatable chromogenic composition on the front surface of substrate 12, which upon heating with a thermal printer provides, for example, a black color.

The self-contained heat-activatable chromogenic compositions comprise a chromogen, which is a color-former compound that is colorless or substantially colorless before reacting with the color developer to produce the colored image. Suitable types of chromogenic color former compounds include, for example, diarylmethanes, triarylmethanes, indolylphthalides, azaphthalides, fluorans, and spiropyrans. Exemplary diarylmethanes include 4,4'-bis(dimethylaminobenzhydrylbenzyl)ether, N-halophenyl leuco auramine, and N-2,4,5-trichlorophenyl leuco auramine. Examples of triarylmethanes include 3,3-bis(p-dimethylaminophenyl)-6-dimethylaminophthalide and 3,3-bis(p-dimethylaminophenyl)phthalide. Examples of indolylphthalides include 3-(p-dimethylaminophenyl)-3-(1,2-dimethylindole-3-yl)phthalide, 3,3-bis(1-octyl-2-methylindol-3-yl)phthalide and 3-(p-dimethylaminophenyl)-3-(2-methylindole-3-yl)phthalide. Examples of azaphthalides include 3-(2-ethoxy-4-diethylaminophenyl)-3-(1-octyl-2-methylindole-3-yl)-4-azaphthalide and 3-(2-ethoxy-4-diethylaminophenyl)-3-(1-ethyl-2-methylindole-3-yl)-4-azaphthalide. Examples of fluorans include 2-dibenzylamino-6-diethylaminofluoran, 2-anilino-6-diethylaminofluoran, 3-methyl-2-anilino-6-diethylaminofluoran, 2-anilino-3-methyl-6-(ethyl-isopentylamino)fluoran, 2-anilino-3-methyl-6-dibutylaminofluoran, 2-chloro-3-methyl-6-diethylaminofluoran, 3,6-dimethoxyfluoran, and 7,7'-bis(3-diethylaminofluoran). Examples of spiropyrans include 3-methylspirodinaphthopyran, 3-ethylspirodinaphthopyran, 3,3'-dichlorospirodinaphthopyran, 3-benzylspirodinaphthopyran, and 3-methylnaphtho-(3-methoxybenzo)spiropyran.

Preferred color developers are acidic compounds which have melting or softening points of about 40° C. to about 200° C. In preferred embodiments of the invention, the lower melting point color developers having melting or softening points preferably from about 40° C. to about 140° C., preferably from about 50° C. to about 110° C., with from about 50° C. to about 80° C. being especially preferred so that the colored image is easily formed by applying frictional heat or similar low temperatures. The color developer melting point should, however, be sufficiently high to avoid melting and thus premature activation and formation of the colored image during drying of the coating, shipping and handling of the document. Examples of useful color developers include, for example: 4,4'-isopropylidenediphenol, 4,4'-isopropylidene-bis(2-tertbutylphenol), 4,4'-sec-butylidenediphenol, 2,2'-methylene-bis(4-chlorophenol), phenol-formaldehyde novolak resin, alpha-naphthol, beta-naphthol, p-hydroxybenzyl benzoate, 3,5-dimethyl-4-hydroxybenzoic acid, 3-isopropylsalicylic acid, 3-benzylsalicylic acid, 3,5-di-tert-butylsalicylic acid, 1,5-di(4-hydroxyphenylthio)-3-oxapentane, 4-hydroxyphenyl-4'-isopropoxyphenylsulfone, bis(3-allyl-4-hydroxyphenyl)sulfone, 4,4'thiodiphenol, and 3,3'-dimethyl-4,4'thiodiphenol.

The proportions of color former and color developer in the coating varies according to the required color density of the image. Generally, about 1 to 50 parts by weight, and preferably about 1 to 10 parts by weight, of color developer is used per part by weight of color former to produce a colored image with sufficiently sharp contrast to readily distinguish the colored image from other visible images on the document. Suitable chromogenic color formers and color developers are disclosed in Chang et al. U.S. Pat. No. 5,618,063, the entire disclosure of which is hereby incorporated by reference.

When the color developers have a high melting point, a heat-fusible material may be used in the chromogenic composition to lower the activation point or temperature of the color developer to facilitate the color development. Exemplary heat-fusible materials include stearic acid amide, stearic acid methylene bisamide, oleic acid amide, palmitic acid amide, coconut fatty acid amide, monoethanolamide of fatty acid, dibenzyl terephthalate, p-benzyl biphenyl, beta-naphthol benzyl ether, ethylene glycol-m-tolyl ether, di(p-chlorobenzyl) oxalate, dibenzyl oxalate and di(p-methylbenzyl) oxalate.

The heat activatable chromogenic composition of the present invention may optionally additionally contain a color suppressant to prevent premature coloration. The color suppressant must be so chosen that it will not inhibit or adversely affect the color formation in the final product. Examples are ammonium hydroxide, alkanolamines, such as monoethanol amine, diethanolamine, N,N-dimethylethanolamine, and the like, condensates of amine-formaldehyde, such as urea-formaldehyde, melamine-formaldehyde, and the like. Suitable amounts of such color suppressants include from about 0.1 to about 10, preferably from about 0.5 to about 4 percent by weight based on the total dry weight of the coating composition. Other suitable color suppressants are disclosed, for example, in U.S. Pat. Nos. 4,010,292 and 4,170,483, which are hereby incorporated by reference.

The chromogenic coating composition may be prepared by a number of methods as known in the art. A preferred method of preparing the coating composition is to disperse one or more of the reactants into a volume of water as a dispersing medium. The reactants are generally ground for about one hour to a particle size of about 1 to 10 microns in diameter. The reactants may be ground in the presence of dispersants. Examples of suitable dispersants include sodium dioctylsulfosuccinate, sodium dodecylbenzene sulfonate, alginates and fatty acid metal salts. The chromogenic compound and the color developer may be mixed together and applied as one coating or prepared as separate coating compositions and applied in layers as discussed hereinafter in greater detail. The reactants are then ground or pulverized in a suitable device such as, for example, a ball mill, sand mill or attritor.

Referring again to FIG. 1, the black-imaging chromogenic coating 14 is fully covered with a coating of a transparent, heat-resistant topcoat 16 as supplied by the manufacturer. The dry topcoat may be water-soluble, and yet heat-resistant, such as topcoats used on facsimile paper, or it may be water-insoluble. Heat-resistant topcoats are typically provided by manufacturers of fully coated papers having heat sensitive chromogenic coatings, and thus such materials are commercially available. Topcoat materials include, for example, TPEXBOO1, which is an acrylic emulsion commercially available from Werneke Ink of Plymouth, Minn., MSEXB005 also from Werneke Ink, AWMI-1 from Arcar Graphics, West Chicago, Ill., and WVH 10624 from Water Ink Technologies, Lincolnton, N.C.

In accordance with the present invention, dual-functional opaque coatings 18 and 20 are spot coated onto topcoat 16 to serve as color blockers for localized self-contained, chromogenic, heat-activatable coatings 22 and 24, respectively. Opaque coatings 18 and 20 also serve as primer coats for self-contained chromogenic coatings 22 and 24, respectively. Opaque coating 18 contains a suitable opacifying agent, which may be an inorganic or organic pigment, known for increasing opacity in paper making, such as titanium dioxide, kaolin, talc, calcium carbonate, magnesium carbonate, barium carbonate, aluminum hydroxide, zinc oxide, silicone oxide, urea-formaldehyde resin, styrene-methacrylic acid copolymer, polystyrene resin, polycarbonate resin, polypropylene resin. Titanium dioxide is preferred. Such opacifying pigments are well-known in the art. Opacifying microcapsules are disclosed, for example, in U.S. Pat. Nos. 3,781,230 and 3,839,064, the disclosures of which are hereby incorporated by reference, and may be employed as well.

The dual-functional opacifying coating is prepared by dispersing a mixture of opacifying pigment, binder and, preferably, additional binder, including the topcoat material used to topcoat the chromogenic composition to which the opacifying coating is to be applied, to form a slurry in which the opacifying pigment is well dispersed.

The amount of opacifying pigment used may vary depending on the color former, color developer and support material. Suitable amounts include between about 0.2 and about 2.0 dry pound per 1300 square feet, preferably between about 0.5 and about 1.0 dry pound per 1300 square feet.

In accordance with the present invention, opaque coatings 18 and 20 contain a dispersing agent. Suitable dispersants include polyvinyl alcohol, starch, hydroxyethyl cellulose, methyl cellulose, carboxymethyl cellulose, gelatin, casein, gum arabic, styrene-maleic anhydride copolymers, ethylene-acrylic acid copolymers, styrene-butadiene copolymers, acrylonitrile-butadiene copolymers and polyvinylpyrrolidone.

In accordance with the present invention, opaque coatings 18 and 20 contain a binding agent for adhering coatings 22 and 24, which is a material that is hydrophobic when dried, hereinafter termed "hydrophobic binders". Suitable hydrophobic binder materials, which are also suitable topcoat materials for the present heat-sensitive system, include silicone-modified polyvinyl alcohol, polyvinylbutyral, polystyrene, polyvinyl acetate, polyvinyl chloride emulsion, polyvinylidene chloride emulsion, vinyl chloride-vinyl acetate copolymer, ethylene-vinyl acetate copolymer, polyurethane emulsion, polyacrylamide emulsion, acrylic polymers, and the like. Especially preferred hydrophobic binder materials for inclusion in the opaque coating and as a topcoat material for use in the present invention includes acrylic polymers, such as acrylamide-acrylic ester copolymer, acrylamide-acrylic ester-methacrylic terpolymer, polyacrylic ester, polymethacrylic ester, styrene-acrylic latex, vinyl acetate-acrylic acid ester copolymer emulsion and vinylidene chloride-acrylic acid ester copolymer. Some of the foregoing polymers are already hydrophobic in nature when dispersed or suspended in a latex emulsion prior to application and drying, while others are water-soluble until applied as a protective coating and dried, at which time they become hydrophobic. In both cases, the polymer is hydrophobic when dried, and is termed herein a "hydrophobic binder".

Such hydrophobic polymeric binding agents have been used as binders in the topcoat and other layers and are, for example, disclosed in U.S. Pat. Nos. 5,482,912, 5,464,804, 5,405,821, 5,478,695, 5,524,934 and 5,543,382, the disclosures of which are hereby incorporated by reference. Preferred hydrophobic binders and topcoat material include commercially available topcoat material including acrylic emulsion TPEXB0001, which is commercially available from Werneke Ink of Plymouth, Minn.; MSEXB005 also from Werneke Ink, AWMI-1 from Arcar Graphics, West Chicago, Ill., and WVH 10624 from Water Ink Technologies of Lincolnton, N.C.

The amount of total binder generally used is about 10 percent to about 50 percent by weight, and preferably about 15 percent to about 35 percent by weight, based on the total weight of the solids of the opaque coating slurry. By incorporating hydrophobic binders in opaque coatings 18 and 20, it was found that the opaque coating provides good adhesion both to the topcoat and as an intermediate coating facilitating adherence of the overlying chromogenic coatings 22 and 24 to the opaque coatings, respectively.

Each of the chromogenic coatings 22 and 24 comprises a self-contained substantially colorless, heat activatable chromogenic composition which provides a color different from the developed color of coating 14, and is coated as a spot coating within the boundaries of opaque coatings 18 and 20, respectively. Thus, coating 22 may cover only a portion of underlying opaque coating 18 rather than all of coating 18 and still achieve the desired blocking and priming effect. Coating 24 can be a green-imaging heat-sensitive chromogenic composition, while coating 22 can provide, for example, a red color upon heating. Thus, when the heated stylus of a thermal printer is applied to coating 22, the purchase order number "878785579" will appear in red, since coating 22 is red-imaging and thus be highlighted to contrast information such as the addressee, the carrier, etc., which appears in black, since coating 14 is black-imaging. Localized coating 24 may be used by the addresser, for example, to highlight information of choice, such as instructions, on the surface of coating 24 in green or some other color by application of a thermal printer. By highlighting the purchase order and other selected information of choice, the recipient can focus on the highlighted information and facilitate confirmation of receipt of the order.

Instead of the rectangular shaped localized coatings 22 and 24, a printing device may be used to apply latent images of the self-contained red-imaging chromogenic coating as a latent image in alphanumeric form with the same high image quality achieved. Alternatively, the latent images can be, for example, in the form of a business logo, design, diagram, serial number, combinations of letters and numbers, or other indicia capable of identifying documents.

The localized self-contained chromogenic coatings may be multiple coatings of the same chromogenic composition or may be of different chromogenic compositions, as desired. The shape of the localized coatings may be in any desired form, including stripes, rectangles, round, oval or any other geometric configuration. Localized coatings may be spaced apart, adjacent or can partially overlap.

Use of opaque coatings 18 and 20 beneath chromogenic coatings 22 and 24, respectively, improves the image quality of the spot-coated chromogenic coatings by preventing the underlying black image, which develops when heat is applied to develop the red-imaging spot coatings, from showing through and diluting the bright red colors. As hereinafter demonstrated in the examples, use of the dual-functional opaque coating of the present invention, provides much better image quality than can be achieved using an opacifying agent, such as titanium dioxide, in the spot-coated chromogenic coatings. Moreover, use of topcoat material as a binder in the opaque coating serves to improve adhesion of the spot-coated chromogenic coatings to the underlying chromogenic coating.

Localized and opaque coatings 18 and 20, as well as localized chromogenic coatings 22 and 24 can be applied by any suitable coating technique known to the art. In one embodiment of the invention, the chromogenic coating composition is prepared as a slurry comprising the color former and the color developer. A preferred method of coating is by off-set gravure coating as disclosed in U.S. Pat. No. 4,425,386 to Chang which is hereby incorporated by reference. Alternative preferred coating methods include flexographic, screen printing, nozzle extrusion and ink jet printing.

While chromogenic coatings 22 and 24 are depicted as being coextensive with coatings opaque coatings 18 and 20, respectively, the opaque coatings may be greater in area than is the chromogenic coating which it supports, so long as the opaque coating is at least coextensive with the chromogenic coating.

Referring again to FIG. 1, label 10 has a pressure sensitive adhesive coating 26 on the back of substrate 12, which substrate can be, for example, paper, plastic, or the like. Label 10 is provided with a release liner backing 28 for the pressure sensitive adhesive coating 26. When the label is ready for use, the release liner is removed and the label adhered to the package to be shipped. A clear, heat-resistant topcoat 30, which comprises the hydrophobic binder material of the present invention, such as an acrylic emulsion TPEXB0001 from Werneke Ink of Plymouth, Minn., is applied as a final coat over the front of the entire label to prevent build-up of the chromogenic material on the heated printer stylus used to form the visible images in FIG. 1.

Figure 2:
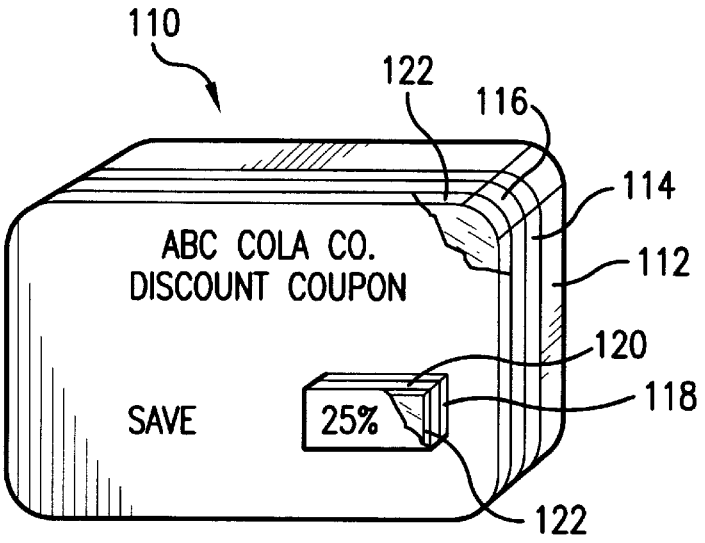
FIG. 2 is a schematic and perspective view of a discount coupon having thermally printed discount information highlighted in accordance with the present invention.

FIG. 2 illustrates another embodiment of the present invention in which a coupon 110 comprising fully coated paper substrate 112 is provided with a coating 114 of a substantially colorless, self-contained, heat-activatable chromogenic composition, which upon heating by a thermal printer or the like, provides a black color. A heat-resistant topcoat 116, which may contain a hydrophobic binder, is coated over chromogenic coating 114. Opaque coating 118 containing a titanium dioxide opacifying agent and a hydrophobic binder, is spot coated onto the surface of topcoat 116 to provide a primer coat for localized chromogenic coating 120. Coating 120 comprises a substantially colorless, heat activatable chromogenic composition. A heat-resistant topcoat 122, which is the hydrophobic binder of the present invention and can be the same material as the hydrophobic binder of opaque coating 118, is coated as the final coat over the entire surface of the coupon.

In order to highlight the coupon discount, which as illustrated in FIG. 2 as "25 percent", chromogenic composition 120 produces a red color on heating. Since the information remains the same on each discount coupon 110, the same data can be highlighted on each coupon, if desired. Thus, coating 120 produces a red color upon contact by a thermal printer to yield the "25 percent" in red while the remaining lettering shown outside coating 120, such as "ABC COLA CO.", is thermally activated to a black color.

The opacifying coating of the present invention has wide application and can be used to improve image quality and adhesion in various documents used for color highlighting, as demonstrated with the documents in FIGS. 1 and 2. Additionally, the present invention can be used in the preparation of documents developed for security purposes in which the heat-activatable chromogenic compositions are used to verify authenticity of the document.

Figure 3:
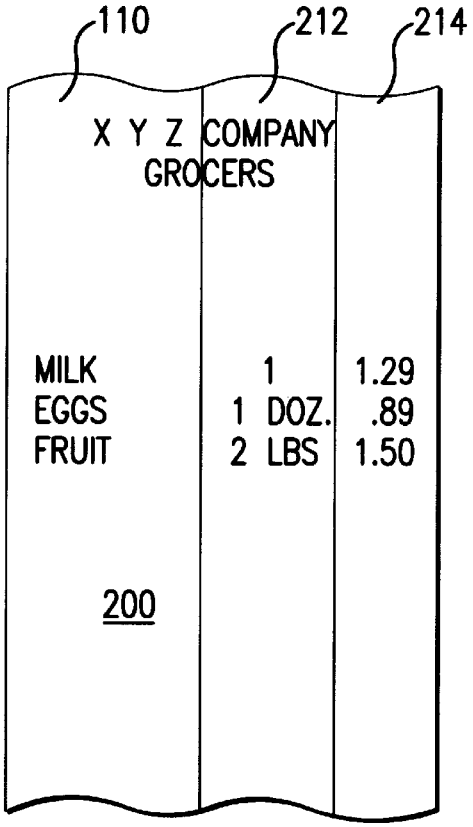
FIG. 3 is a front partially sectioned view of a cash register receipt having thermally printed highlighted matter in multiple colors.

In the embodiment of FIG. 3, a cash register receipt form 200 comprises a paper substrate that has been fully coated with a substantially colorless coating 110 of a heat activatable chromogenic composition having a heat-resistant, transparent topcoat along the entire length of receipt 200. Coating 110 can be directly heated by the stylus of a thermal printer to provide, for example, a black image. The opaque coating of the present invention containing an opacifying agent and a hydrophobic binder material, which may be similar to the binder in the topcoat material, is coated over the black imagable chromogenic coating in both areas 212 and 214 of receipt 200. Each of adjacent areas 212 and 214 are then coated, respectively, with a different color developable localized, self-contained, substantially colorless, heat activatable chromogenic composition over the opaque coating in the form of a continuous, longitudinal stripe. Thus, the coating in area 212 can be heated to provide a blue color, while the coating in area 214 can be heated to provide a red color at any point along the length of receipt 200 in area 214. The entire surface of the receipt is coated with a final topcoat of the hydrophobic binder of the present invention. Since the opacifying coating blocks out the black color in each of areas 212 and 214, the image quality of the blue and red colors is much improved.

When receipt 200 is imprinted by means of the stylus of a thermal printer of a grocery store cash register, the price of each of the grocery items, for example "1.29" will appear in red, the quantity, for example "1 DOZ." in blue and the name of the item, for example, the word "MILK" will appear in black, each having excellent image quality.

By highlighting the various items in this manner, the resulting receipt 200 enables the customer to immediately locate the item, and its price, if desired. Later, if the customer presents receipt 200 to a store employee with one or more of the listed items for return and a cash refund, the store employee can verify that the receipt is authentic by heating any portion of the face of the receipt, e.g., by running a fingernail across the heat activatable width of the receipt. If the receipt is authentic, the employee will see a line composed of red, blue and black segments. If the receipt is an unauthorized photocopy, no such multicolored line will appear. This will prevent dishonest persons from shoplifting grocery items along with purchased items, and returning the illicit items for cash.

Figure 4:
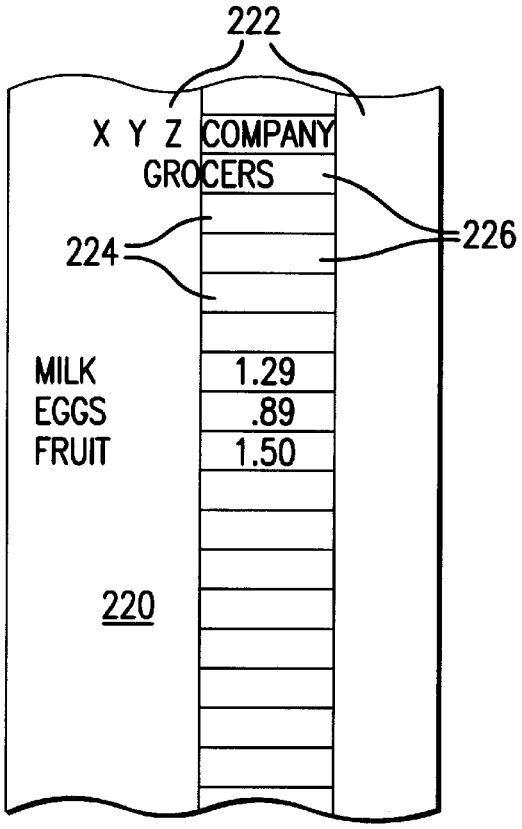
FIG. 4 is a front partially sectioned view of a cash register receipt having thermally printed highlighted matter.

FIG. 4 is a cash register receipt illustrating another embodiment of the invention in which receipt 220 is provided with a fully coated surface of a topcoated, substantially colorless, heat activatable chromogenic composition, which can be directly heated by the stylus of a thermal printer in areas 222 to provide, for example, a black color. The fully coated surface is, in turn, spot coated with an overcoat of the opaque coating of the present invention in the form of a continuous longitudinal strip, which, in turn, is overcoated with a series of rectangularly shaped, localized coatings 224 and 226 of a heat activatable chromogenic composition which, alternatively, vary in the color produced upon heating and form a continuous, longitudinal stripe along the length of receipt 220. The entire surface of receipt 220 is coated with a final heat-resistant topcoat comprising the hydrophobic binder of the present invention. Thus, for example, localized coatings 224 will produce a red color image upon contact by the thermal printer, while localized coatings 226 will produce a blue color upon contact by the thermal printer. This alternating color-producing sequence continues for the length of the stripe. Obviously, more than two different colors may be used, if desired, to provide alternating colors in a repetitive fashion. Similarly, other portions of the surface of receipt 220 could be coated with alternating localized coatings of heat activatable chromogenic compositions, if desired.

Verification of receipt 220 can be accomplished in the same manner as described for receipt 200, since application of heat, such as by applying the frictional heat of a fingernail across receipt 220, will provide one or more colors if the receipt is authentic and not an unauthorized copy.

Figure 5:
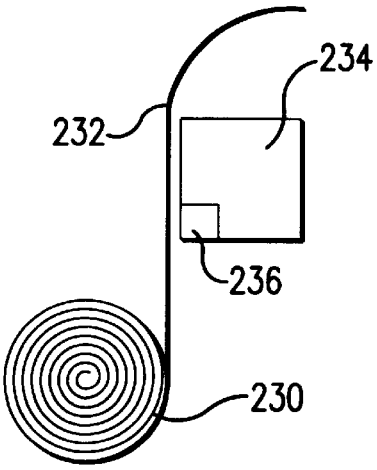
FIG. 5 is a partial, schematic and side elevational view of a continuous form cash register receipt being contacted with the stylus of a computer controlled thermal printer imprinting data on the face of the receipt form.

FIG. 5 is a schematic in which a continuous cash register receipt in the form of roll 230 is being fed such that receipt form 232 is contacted with the stylus of a computer controlled thermal printer 234 to imprint data on the face of the receipt form, illustrated in FIGS. 3 and 4. The visible, colored images appearing on the receipt paper are formed by contact of the heated stylus 236 of the thermal printer 234 on the receipt paper. The information provided to the receipt paper can vary depending on use of the paper, for example, a receipt for a cash register or an ATM machine, so that placement of the localized coatings and their shape can be tailored to highlight the information desired for a particular application or customer.

The chromogenic coating material may be activated by any suitable means which provides heat to the coating, such as the heated stylus of a thermal printer. Verification that the document, such as a cash register receipt, discount coupon, or the like, is authentic may be achieved by activating portions of the chromogenic coating by any desired means, such as by quickly rubbing a blunt implement across the verification area to generate sufficient frictional heat to produce a colored image. For convenience, a suitable implement may be a fingernail rubbed quickly across the verification area to generate frictional heat and produce a colored line. Other implements which may be used include a non-writing end of a pen, a stylus, paper clip, coin and the like. Generally, metal objects are not as effective in producing a colored image since the metal conducts the frictional heat quickly away from the point of contact and has a lower friction coefficient than many other objects. Thus, a fingernail or plastic object is generally preferred.

However, any suitable means for applying sufficient heat, whether frictional or otherwise, can be used to heat the chromogenic composition and produce a visible colored image. The heat providing means should be capable of heating the chromogenic composition to a temperature of between about 40° C. to about 200° C., preferably between about 40° C. to about 140° C., with between about 50° C. and about 80° C. being especially preferred for certain applications. Thus, suitable heat sources include thermal printers, ordinary electric light bulbs, for example, 80–150 watt bulbs, hand-held electric hair dryers, coffee mugs containing a hot liquid, or like devices which generate such temperatures. Similarly, a heated metal element, such as a flat plate-like element for direct application of heat to the chromogenic composition, may be used.

The invention will be further illustrated by the following examples. All percentages are by weight unless otherwise specified. It should be understood that it is not intended to limit the scope of this invention.

EXAMPLE 1

An opacifying coating was prepared by stirring a mixture of 27.0 grams of titanium dioxide, 18.6 grams of 7.5 percent Vinol 205 polyvinyl alcohol (from Air Products and Chemicals, Inc.) aqueous solution, 0.4 grams of SE 21 defoamer (from Wacker Silicone Corp., Adrian, Mich.), 4.0 grams of glycerol, and 50.0 grams of TPEXB0001 (an acrylic emulsion from Werneke Ink, Plymouth, Minn.) until the titanium dioxide particles were well dispersed.

The slurry was then spot-coated on Appleton 2062 black-imaging direct thermal paper (commercially available from Appleton Paper Inc., Appleton, Wis.). The dry coated paper was substantially colorless. Upon heating it in an oven at about 230° F., the spot-coated area appeared white, while the rest of the surface turned black. The opaque coating effectively blocked the black color underneath from showing through to the upper surface.

EXAMPLE 2

A color former dispersion was prepared by grinding 27.2 grams of the color former, crystal violet lactone, as a blue color former, and 2.8 grams of SE 21 defoamer in 70 grams of 10 percent Vinol 205 polyvinyl alcohol aqueous solution for about 90 minutes. The total solids content of the dispersion was 35.3 weight percent.

EXAMPLE 3

A color developer dispersion was prepared by grinding a mixture of 30.75 grams of 4-hydroxy-4'-isopropoxydiphenyl sulfone, 5.12 grams of SE 21 defoamer, and a solution of 9.63 grams Vinol 205 polyvinyl alcohol in 54.5 grams of water in a stainless steel ball mill until a particle size of about 1 to about 3 microns was obtained. The total solids content of the resulting dispersion was 42.43 weight percent.

EXAMPLE 4

A titanium dioxide dispersion was prepared by dispersing 60 grams of titanium dioxide and one gram of SE 21 defoamer in a solution of three grams of Vinol 205 polyvinyl alcohol in 36 grams of water, using a high speed mixer. The total solids content of the dispersion was 63.4 weight percent.

EXAMPLE 5

A heat-sensitive coating containing titanium dioxide was prepared by mixing 100 parts of color former dispersion of Example 2, 400 parts of color developer dispersion of Example 3, 100 parts of titanium dioxide dispersion of Example 4, and 25 parts of SE 21 defoamer under mild agitation. The total solids content was 44.6 weight percent. The resulting slurry was coated on a portion of Appleton 2062 black-imaging direct thermal paper surface and the opaque coating, prepared as in Example 1. A topcoat was applied, using TPEXB0001 from Werneke Ink.

The color was developed in an oven at about 230° F. Black color developed in the area without the opaque coating or the blue color-forming composition. A blackish shade of blue appeared outside the opaque area. A whitish shade of blue appeared within the opaque area.

This demonstrates that incorporation of titanium dioxide into the color coating slurry reduced the blue image intensity.

EXAMPLE 6

A heat-sensitive coating without titanium dioxide was prepared by mixing one part of color former dispersion of Example 2 and four parts of color developer dispersion of Example 3. The total solids content of the resulting slurry was 41.0 weight percent. For the purpose of a fair comparison, the ratio of the color former to color developer in this test was the same as that of Example 5. The resulting slurry was locally coated on paper prepared as in Example 1, covering portions of the opaque coating and the original surface of Appleton 2062 black-imaging direct thermal paper. A topcoat was applied, using TPEXB0001 from Werneke Ink.

Upon developing the color in an oven at about 230° F., black color developed in the area without the opaque coating, an extremely pale second blue (much less visible that the blue of Example 5) was observed in the area outside the opaque coating, and a very vivid blue was seen within the opaque coating. The very vivid blue within the opaque coating in this experiment was much superior in color quality to that of Example 5.

This test demonstrates that the titanium dioxide opacifying particles were able to block the black color of the underlying substrate to a much lesser extent when incorporated with the chromogen as in Example 5, than does the titanium dioxide-containing opaque coating of Example 6. Thus, the opacifying coating provides much better image quality.

Repeating the tests of Examples 5 and 6 using Copikem V, which is a green developing chromogen, and Pergascript I-6B, which is a red developing chromogen, in place of the crystal violet lactone, yields the same results.

Accordingly, the opaque coating of the present invention can block the first color completely or substantially such that it is able to provide undiluted, unmasked, true color which incorporation of the opacifying pigment in admixture with the chromogen cannot provide.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A document capable of providing multiple colors, which comprises:

a support having at least one surface bearing a first coating comprising a substantially colorless, heat-sensitive chromogenic composition capable of producing a first color, a second coating covering a portion of said first coating, said second coating being a substantially opaque coating comprising an opacifying agent and a hydrophobic, polymeric binder, and a third coating covering at least a portion of said second coating comprising a substantially colorless, heat-sensitive chromogenic composition capable of producing a second color, each said heat-sensitive, chromogenic composition comprising a color former and a color developer, said color former and said color developer being substantially colorless, but which can chemically react upon application of heat to produce a visible colored image, said first and second coatings being non-coextensive.

2. The document of claim 1, wherein a fourth coating is located between said first and second coatings, said fourth coating comprising a heat-resistant coating.

3. The document of claim 2, wherein said fourth coating comprises a hydrophobic polymeric binder.

4. The document of claim 2, wherein a fifth coating is provided as a topcoat over said third coating.

5. The document of claim 4, wherein said fifth coating comprises a hydrophobic polymer.

6. The document of claim 5, wherein said fifth coating comprises an acrylic polymer.

7. The document of claim 5, wherein the hydrophobic polymer binder of said fifth coating and the hydrophobic polymer binder of said second coating have the same composition.

8. The document of claim 2, wherein said fourth coating is water-resistant.

9. The document of claim 2, wherein said fourth coating is water-soluble.

10. The document of claim 2, wherein said first coating is coextensive with said substrate.

11. The document of claim 2, wherein said first and third coatings are each heat activatable at a temperature in the range of between about 40° C. and about 200° C.

12. The document of claim 2, wherein said first and third coatings of a heat activatable chromogenic composition are each activatable by application of frictional heat.

13. The document of claim 2, wherein each said chromogenic composition further comprises an activation temperature suppressant material.

14. The document of claim 1, which said hydrophobic binder comprises an acrylic polymer.

15. The document of claim 1, wherein said second and said third coatings are substantially co-extensive.

16. The document of claim 1, wherein multiple third coatings cover portions of said second coating.

17. The document of claim 1, wherein said opacifying agent is an inorganic pigment.

18. The document of claim 17, wherein said opacifying agent is titanium dioxide.

19. The document of claim 1, wherein said document is a pressure sensitive label, receipt paper, or a redeemable coupon.

20. The document of claim 19, wherein said document is a pressure-sensitive label.

21. The document of claim 19, wherein said document is receipt paper.

22. The document of claim 21, wherein said third coating is in the form of a stripe.

23. The document of claim 22, wherein said stripe is positioned to highlight entries on said receipt paper under the application of heat by a thermal printer.

24. The document of claim 21, wherein said substrate is in the form of a continuous roll.

25. The document of claim 1, wherein said third coating is a localized coating of said chromogenic composition.

26. The document of claim 1, wherein said first and third coatings are substantially parallel stripes on said substrate.

27. The document of claim 1, in which said first color is black and said second color is red.

28. A method of providing a multicolor chromogenic document which comprises:

coating at least one surface of a support with a first coating comprising a substantially colorless, chromogenic composition capable of producing a first color under application of heat, applying a second coating over a portion of said first coating, said second coating comprising a substantially opaque, localized coating comprising an opacifying agent and a polymeric, hydrophobic binder, applying a third coating over at least a portion of said second coating, said third coating comprising a substantially colorless, chromogenic composition capable of producing a second color under application of heat, each said chromogenic composition comprising a color former and a color developer, said color former and said color developer being substantially colorless, but which can chemically react to produce a visible colored image under application of heat, said first and second coatings being non-coextensive.

29. The method of claim 28, wherein a fourth coating comprising water-insoluble, heat-resistant material is interposed between said first and second coatings, and said binding agent in said second coating comprises said fourth coating material.

30. The method of claim 29, wherein a fifth coating is provided as a topcoat over said third coating, said fifth coating comprising a hydrophobic polymeric binder.

* * * * *